US011129477B2

(12) United States Patent
Xiques

(10) Patent No.: US 11,129,477 B2
(45) Date of Patent: Sep. 28, 2021

(54) HIGH-RISE SPORTS CHAIR

(71) Applicant: William Xiques, Beachwood, NJ (US)

(72) Inventor: William Xiques, Beachwood, NJ (US)

( * ) Notice: Subject to any disclaimer, the term of this patent is extended or adjusted under 35 U.S.C. 154(b) by 0 days.

(21) Appl. No.: 16/229,194

(22) Filed: Dec. 21, 2018

(65) Prior Publication Data

US 2020/0196762 A1 Jun. 25, 2020

(51) Int. Cl.

| | |
|---|---|
| ***A47C 4/04*** | (2006.01) |
| ***A47C 7/54*** | (2006.01) |
| ***A47C 7/72*** | (2006.01) |

(52) U.S. Cl.

CPC ..... *A47C 4/04* (2013.01); *A47C 7/54* (2013.01); *A47C 7/72* (2013.01)

(58) Field of Classification Search

CPC ..... A47C 4/04

See application file for complete search history.

(56) References Cited

U.S. PATENT DOCUMENTS

| | | | | |
|---|---|---|---|---|
| 3,715,142 A * | 2/1973 | Lay | A47C 3/02 297/39 |
| 8,926,008 B1 * | 1/2015 | Al-Hasan | A47C 7/72 297/17 |
| 2013/0154315 A1 * | 6/2013 | Kilzer | A47C 1/022 297/180.13 |
| 2016/0242550 A1 * | 8/2016 | Hammock | A47C 4/30 |

* cited by examiner

*Primary Examiner* — David R Dunn
*Assistant Examiner* — Tania Abraham
(74) *Attorney, Agent, or Firm* — Christopher J. Scott

(57) ABSTRACT

The present invention relates to an elevated portable chair that includes: a seat and a pair of collapsible legs, wherein the pair includes a front leg and a rear leg, wherein rear leg extends, and pivots open from a mid-point on the front leg. A rear bracket extends from a rear edge of the seat to a distal end of the rear leg to provide stabilizing support, where a horizontal brace is placed at a midpoint of the rear bracket. Other features of the chair include a back support; a first arm rest; a second arm rest and a solar panel on a top edge of the back support. The solar panel provides a power source for the at least one power outlet provided on the chair.

4 Claims, 1 Drawing Sheet

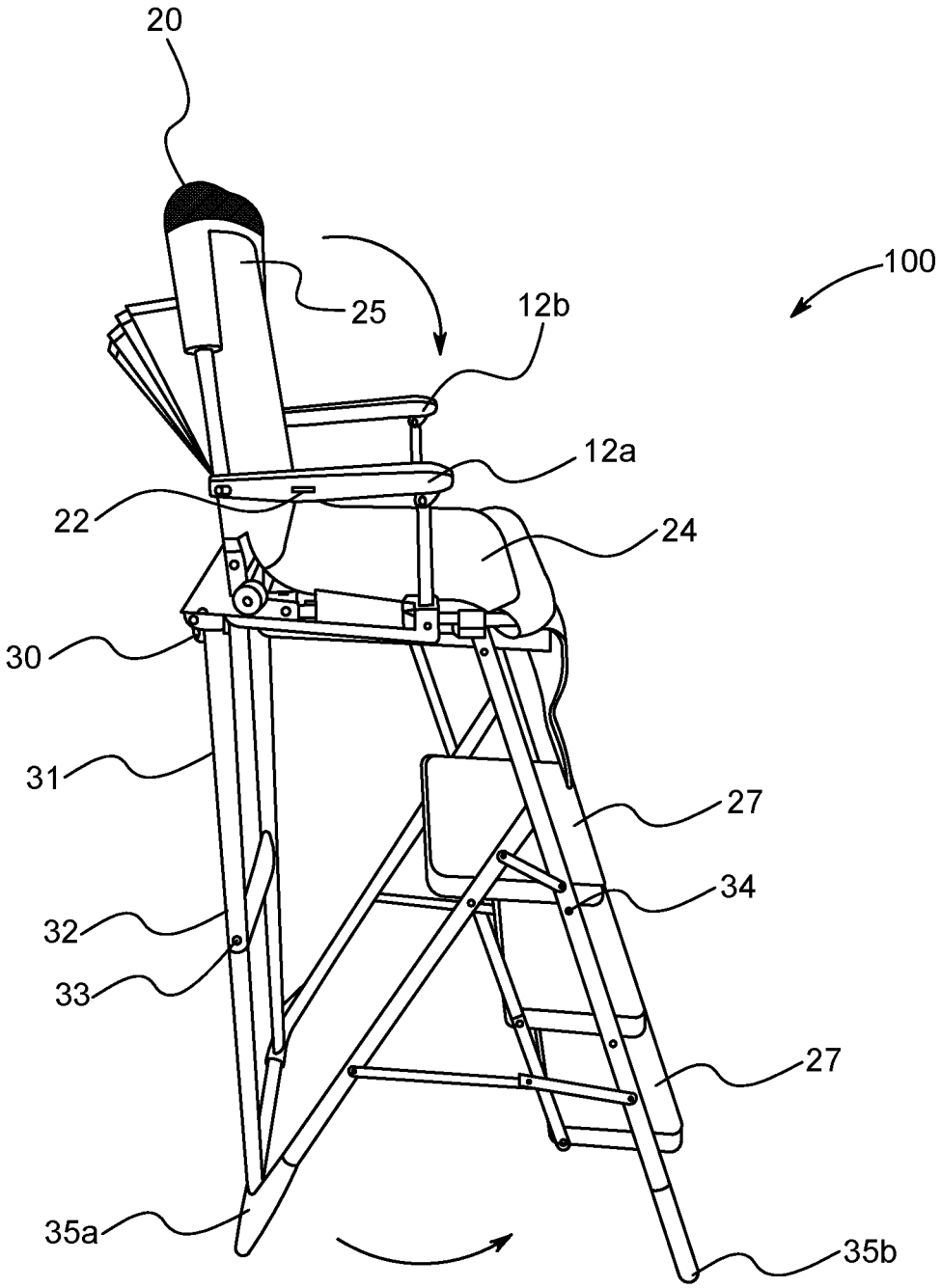
20
25
12b
100
12a
22
24
30
31
27
34
32
33
27
35a
35b

HIGH-RISE SPORTS CHAIR

BACKGROUND OF THE INVENTION

Field of Invention

The present invention relates to a portable elevated chair that may be used for both indoor and outdoor uses.

Description of Related Art

Portable chairs are a common convenience used by many individuals in many applications. Portable chairs are usually in a form, where they may be converted from a folded position to an unfolded position. The folded position allows for storage and transport of the chair from location to location. One common use of the folding chair relates to outdoor recreational activities that allow for convenient opening and folding of a chair for comfortable positioning as needed. Typically, the folding chair sits at a height of about 24 inches from the ground or floor. However, in certain applications such a low sitting position is not optimal for the user. A low sitting position may not provide a satisfying field of vision and the visibility of the user may be restricted due to obstacles or other individuals. Further many of the lower chairs are used in various sporting events, concerts, beaches or other outdoor activities.

One drawback to the conventional folding chair relates to the low sitting position. As a result, it would be advantageous to have a high-rise portable folding chair that may have an elevated seating position.

SUMMARY OF THE INVENTION

The present invention relates to an elevated portable chair that includes: a seat and a pair of collapsible legs, wherein the pair includes a front leg and a rear leg, wherein rear leg extends, and pivots open from a mid-point on the front leg. A rear bracket extends from a rear edge of the seat to a distal end of the rear leg to provide stabilizing support, where a horizontal brace is placed at a midpoint of the rear bracket.

Other features of the chair include a back support; a first arm rest; a second arm rest and a solar panel on a top edge of the back support. The solar panel provides a power source for the at least one power outlet provided on the chair. The chair rear leg pivots about the front leg and a vertical brace extends from the rear leg to the chair. A plurality of steps traverse along the length of the front leg and the rear leg pivots toward the front leg in a closed position while folding the steps closed.

BRIEF DESCRIPTION OF DRAWINGS

FIG. 1 depicts a side prospective view of a high-rise folding chair according to the present invention.

DETAILED DESCRIPTION

The present invention relates to a high-rise or elevated folding chair. The elevated folding chair according to present invention includes various additional features to provide a convenient sitting environment for the user. Features include connectivity for electronic devices in the form of USB connectors to receive portable electronic devices such as a cell phone. Charging is provided by use of a solar charging panel that is installed on a top seating edge of the backrest for the chair. Outlets for connection are available on each folding arm of the foldable chair. Other features include reinforced support and expanding legs. Also, small steps are available to allow for the stepping up into the seat of the chair in an upright position.

In reference to FIG. 1, an elevated chair 100 is depicted according to the present invention. The elevated chair includes folding legs 35(*a*), 35(*b*) leg stand in an inverted "V" shape from a joining point along the leg 35(*b*). These legs are shown in the expanded upright position but are collapsible to a folding position when the chair is not in use. Further support of the chair is provided by a bracket 31 that stems from the rear edge of the seat 24 and adjoins to the rear leg 35(*a*). This bracket 31 further includes a horizontal support bar 32 that provides additional resilient support of the chair and the individual seated therein. The horizontal support bar 32 moves vertically and is locked into place with locking pin 33. Other features of the chair include small steps 27 along the front leg 35(*b*). These steps allow the user to step up into the seat 24. The steps 27 engage the front leg 35(*b*) and a vertical step bracket for support. Side braces attach to the step bracket, rear leg 35(*a*) and front leg 35(*b*). The side braces are adapted to enable the folding of the legs 35(*a*), 35(*b*) and steps 27 into a closed position. Ideally the seat 24 is placed at 42 inches above the floor or ground level from the bottom of legs 35 to seat 24. The overall height of the seat can range up to 60 inches to the top of the backrest 25. Backrest 25 further includes a solar panel 20. Solar panel 20 provides charging for an enclosed battery that supplies power to outlets 22 on each arm 12(*a*), 12(*b*) of the chair.

The backrest 25 and arms 12(*a*), 12(*b*) are collapsible as shown in the arrow in FIG. 1. Once collapsed the chair may be stored in a closed position. The seat 24 locks into a stationary position by the use of locks 30 at the rear of the seat 24. This elevated chair provides customized features that allow for upright sitting position and elevated position as opposed to the traditional folding chair. The chairs may also include other features such as cup holders, padded armrest, pouches or other additional electronic ports for charging purposes.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated.

What is claimed is:

1. An elevated portable chair comprising:

a. a seat;

b. a pair of collapsible legs, wherein the pair includes a front leg and a rear leg, wherein rear leg extends, and pivots open from a mid-point on the front leg, where the rear leg pivots about the front leg and a vertical brace extends from the rear leg to the chair;

c. a rear bracket extending from a rear edge of the seat to a distal end of the rear leg;

d. a horizontal brace at a midpoint of the rear bracket;

e. a back support;

f. a first arm rest;

g. a second arm rest;

h. a solar panel on a top edge of the back support; and i. at least one power outlet on at least one arm rest, wherein the solar panel provides a power source for the at least one power outlet.

2. The elevated portable chair according to claim 1, where a plurality of steps traverse along the length of the front leg.

3. The elevated portable chair according to claim 2, where a step bracket engages each of the plurality of steps.

4. The elevated portable chair according to claim 3, where side braces engage the step bracket, front leg and rear leg, wherein the side braces are adapted to enable of closing of the steps, front leg and rear leg to a closed position.

* * * * *